US006386897B1

(12) United States Patent
Muller

(10) Patent No.: US 6,386,897 B1
(45) Date of Patent: May 14, 2002

(54) ELECTRICAL PLUG CONNECTION WITH A PLUG HOUSING, CONTACT HOUSING AND BAYONET RING FOR LOCKING THE PLUG HOUSING IN THE CONTACT HOUSING

(75) Inventor: Klaus Muller, Oberscheinfeld (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/544,393

(22) Filed: Apr. 6, 2000

(30) Foreign Application Priority Data

Apr. 9, 1999 (DE) ..... 199 16 075

(51) Int. Cl.[7] ..... H01R 13/213

(52) U.S. Cl. ..... 439/314; 439/263; 439/298; 439/301; 439/333

(58) Field of Search ..... 439/314, 317, 439/318, 319, 298, 301, 259, 263, 332, 333

(56) References Cited

FOREIGN PATENT DOCUMENTS

| | | |
|---|---|---|
| DE | 4039240 C2 | 7/1991 |
| JP | 10321296 A | 12/1998 |

*Primary Examiner*—Tho D. Ta
*Assistant Examiner*—Truc Nguyen
(74) *Attorney, Agent, or Firm*—Perman & Green, LLP

(57) ABSTRACT

An electrical plug connection including a plug housing (2), a contact housing (3) complementary to the plug housing (2) and a bayonet ring (4) for locking the plug housing (2) in the contact housing (3). At least one spring element (16) acts on at least one movable rotary slide (6) and, when the bayonet ring (4) is turned so as to close it, exerts an increasing stress on the bayonet ring (4) and, in the event of the bayonet ring being incompletely turned to close it, unturns the latter into its open position. The bayonet ring (4) is locked in its closed position only when it is completely turned so as to close it.

8 Claims, 6 Drawing Sheets

ELECTRICAL PLUG CONNECTION WITH A PLUG HOUSING, CONTACT HOUSING AND BAYONET RING FOR LOCKING THE PLUG HOUSING IN THE CONTACT HOUSING

BACKGROUND OF THE INVENTION

1. Field of the Invention

The invention relates to an electrical plug connection, particularly for motor vehicle applications, comprising a plug housing, a contact housing complementary to the plug housing and a bayonet ring for locking the plug housing in the contact housing.

2. Description of the Prior Art

Plug connections of this kind are mounted mainly in a corresponding wall of a housing, so that the electrical connections of the device in the housing are led out. For example, plug connections of this kind are used as pre-cabling for motor vehicle transmissions. It is particularly in the area of motor vehicle transmissions that very intensive vibrations occur so that care must be taken to ensure that the plug connection cannot automatically work loose.

Known plug connections have locking devices for securing the plug housing in the contact housing. During assembly care must be taken to ensure that the locking device fully engages. It may happen in practice that the locking device is brought only into an intermediate position, in which although the plug housing has been inserted in the contact housing the locking device is not in the closed position so that the plug connection can automatically work loose, for example due to the high vibrations.

SUMMARY OF THE INVENTION

The object of the invention is to provide an electrical plug connection wherein incomplete locking of the plug parts due to assembly errors, with the consequent release effects, are reliably avoided.

This problem is solved by the features the present invention.

The electrical plug connection according to the invention comprises a plug housing, a contact housing complementary to the plug housing and a bayonet ring for locking the plug housing in the contact housing. At least one spring element acts on at least one movable rotary slide and, when the bayonet ring is turned so as to close it, exerts an increasing stress on said bayonet ring and, in the event of the bayonet ring being incompletely turned to close it, unturns the latter into its open position. The bayonet ring is locked in its closed position only when it is completely turned so as to close it.

The effect of the co-operation of the bayonet ring, spring element and rotary slide according to the invention has the effect that the electrical plug connection and its locking device (bayonet ring) are always in a defined state and this state is unmistakably indicated to the fitter. If the bayonet ring is incompletely turned to close it, the coupling of the rotary slide with the bayonet ring by way of the spring element causes the rotary slide to exert a force on the bayonet ring which after the manual rotary force has ceased automatically unturns the ring into its open position. The fitter is thus shown that the bayonet ring has not been engaged and hence cannot fulfill its securing function.

Another special feature of the invention is that when the bayonet ring is turned to close it, the two housings (plug housing and contact housing) of the plug connection are brought together, this being achieved by the configuration of guide grooves on the plug housing to receive studs on the bayonet ring.

This leads to the advantageous possibility of making the connection between the electrical contacts of the plug housing and the electrical contacts of the contact housing only when the bayonet ring has been turned so as to close it. If the housings are just plugged together with the bayonet ring in the open position, there is no electrical connection between the contacts. The bayonet ring occupies two defined positions, i.e. the open position and the closed position, because of the restoring force of the spring element. The configuration of the guide groove has the effect that the two housings are brought together when the bayonet ring is turned to close it, or are moved apart when the bayonet ring is turned to open it. Similarly the electrical contacts of the two housings are brought into electrical connection during the turning in the closing direction and separated on turning in the opening direction. There is accordingly a direct relationship between the position of the bayonet ring and the electrical connection of the corresponding electrical contacts of the two housings. Thus in the closed position the contacts are interconnected while in the open position they are not. If current now flows through the plug connection, it is simultaneously confirmation of the bayonet ring having been turned so as to completely close it.

The retaining elements can be so designed as to withstand the force of the stressed spring. The bayonet ring remains in the closed position, although with the disadvantage that the spring is constantly stressed. This unwanted effect can be avoided by unstressing the spring element just before the bayonet ring engages the plug housing, and this can be achieved by a projection to lift a hook of the spring tongue.

BRIEF DESCRIPTION OF THE DRAWINGS

One preferred embodiment of the plug connection is described hereinafter with reference to the diagrammatic drawing wherein.

DETAILED DESCRIPTION OF THE INVENTION

Figure 1:
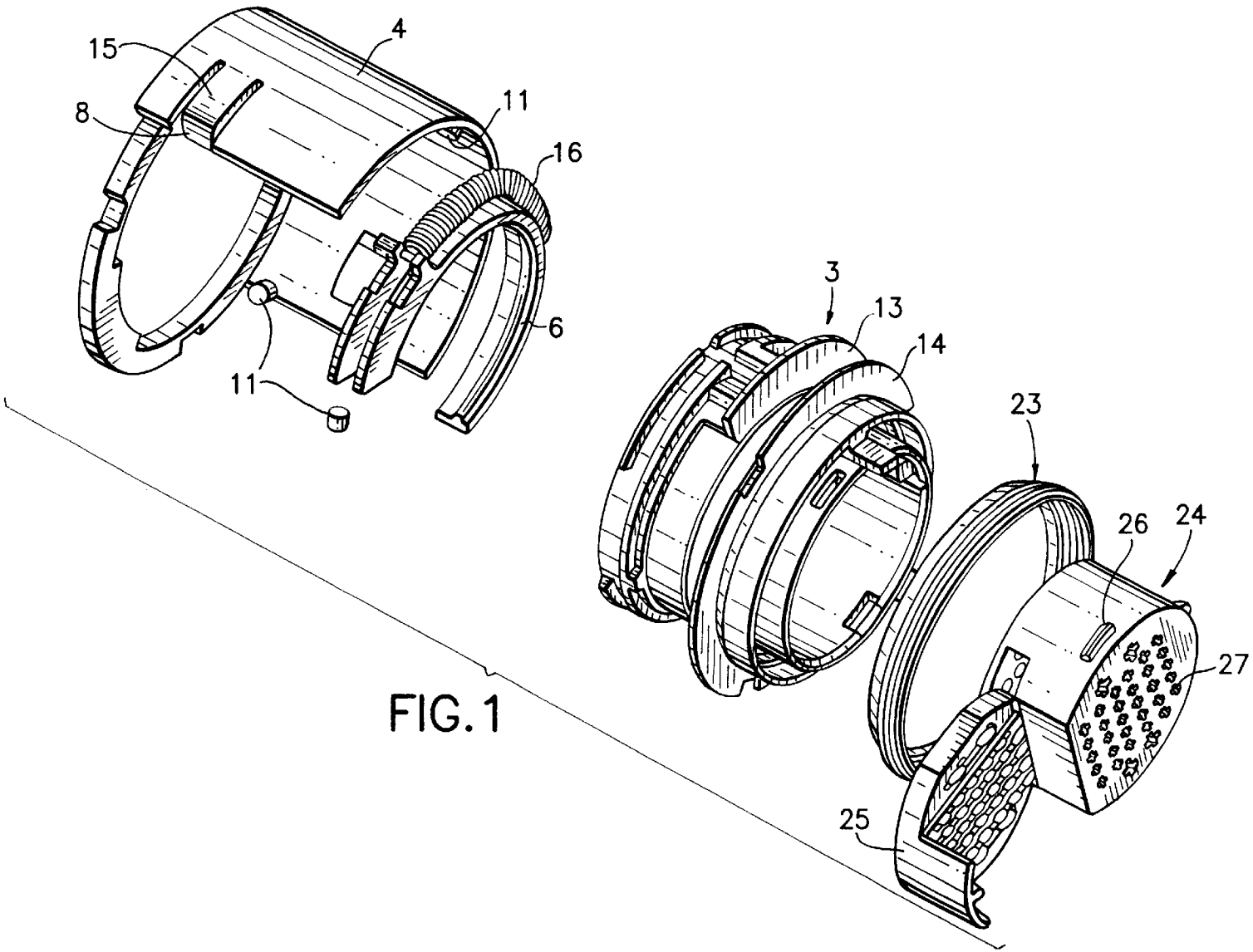
FIG. 1 is an exploded view of a contact part.

The contact part of the plug connection shown in FIG. 1 comprises a bayonet ring 4 with an elastic spring tongue 15 and three studs 11 and a rotary slide 6 constructed as an annular segment, with a tension spring 16. The spring tongue 15, which is integrally formed on the bayonet ring 4 and extends along the periphery thereof, has an inwardly directed hook 8. A contact housing 3 will be seen, with a guide web 13 extending on the periphery, and an annular shoulder 14 for positioning a seal 23. An insert 24 with contact openings 10 is inserted in the cylindrical interior of the contact housing 3 and fixed by a transverse plate 25.

Figure 2:
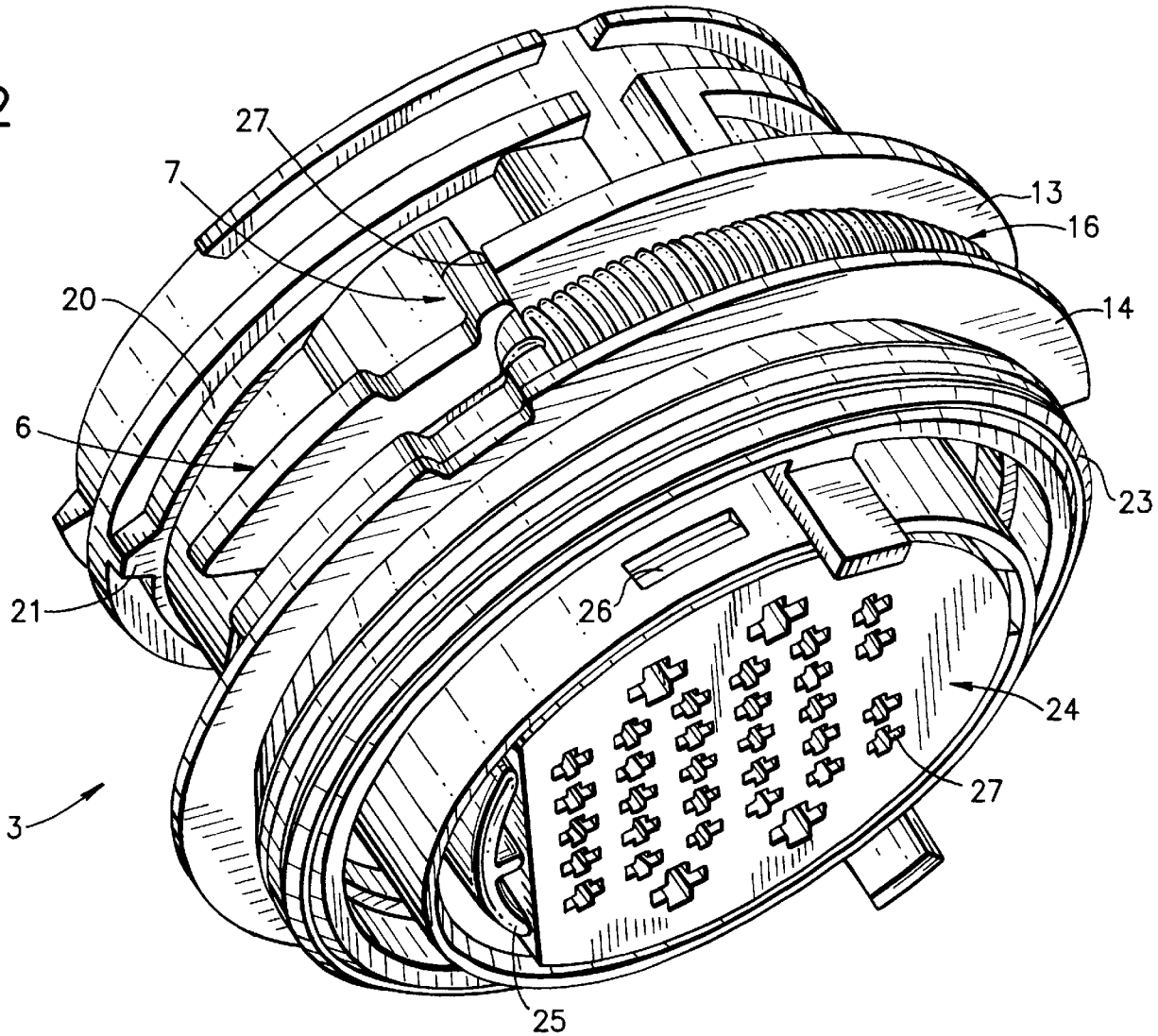
FIG. 2 shows a contact housing of the plug connection.

FIG. 2 is an oblique plan view showing the front of the contact housing 3 in the assembled state without the bayonet ring 4. The transverse plate 25 of the insert 24 is pushed perpendicularly to the direction of insertion. On its peripheral surface the insert 24 has catch shoulders 26, the insert 24 together with the locking means 25 being inserted in the substantially cylindrical opening provided on the front of the contact housing 3. Set off from the front, the profiled seal 23 is disposed on the peripheral surface of the substantially cylindrical contact housing 3. This is followed by the annular shoulder 14 extending over the entire periphery. Behind the annular shoulder 14 is the rotary slide 6, with a first abutment nose 7 formed thereon and extending in the plug direction. One end of the tension spring 16 is engaged on this one end of the rotary slide 6 and rests on the latter while the other end of the spring 16 (not shown) is so fixed on the contact housing 3 that the tension spring 16 is somewhat prestressed in the open position of the bayonet ring. The rotary slide 6 is framed by the annular shoulder 14 and the guide web 13, which of course extends only over a part of the housing periphery. One end of the guide web 13 forms, by its vertical edge 27, an abutment for the rotary slide 6. As will be seen from FIG. 2, one end of the rotary slide 6 bears with the abutment nose 7 against said edge 27. The abutment nose 7 is guided by a shoulder 20 which is also formed over the entire periphery of the contact housing 3. Spaced from the edge 27 a projection 21 is formed on the shoulder 20. The object of this projection 21 will be explained later with reference to FIG. 6.

Figure 3:
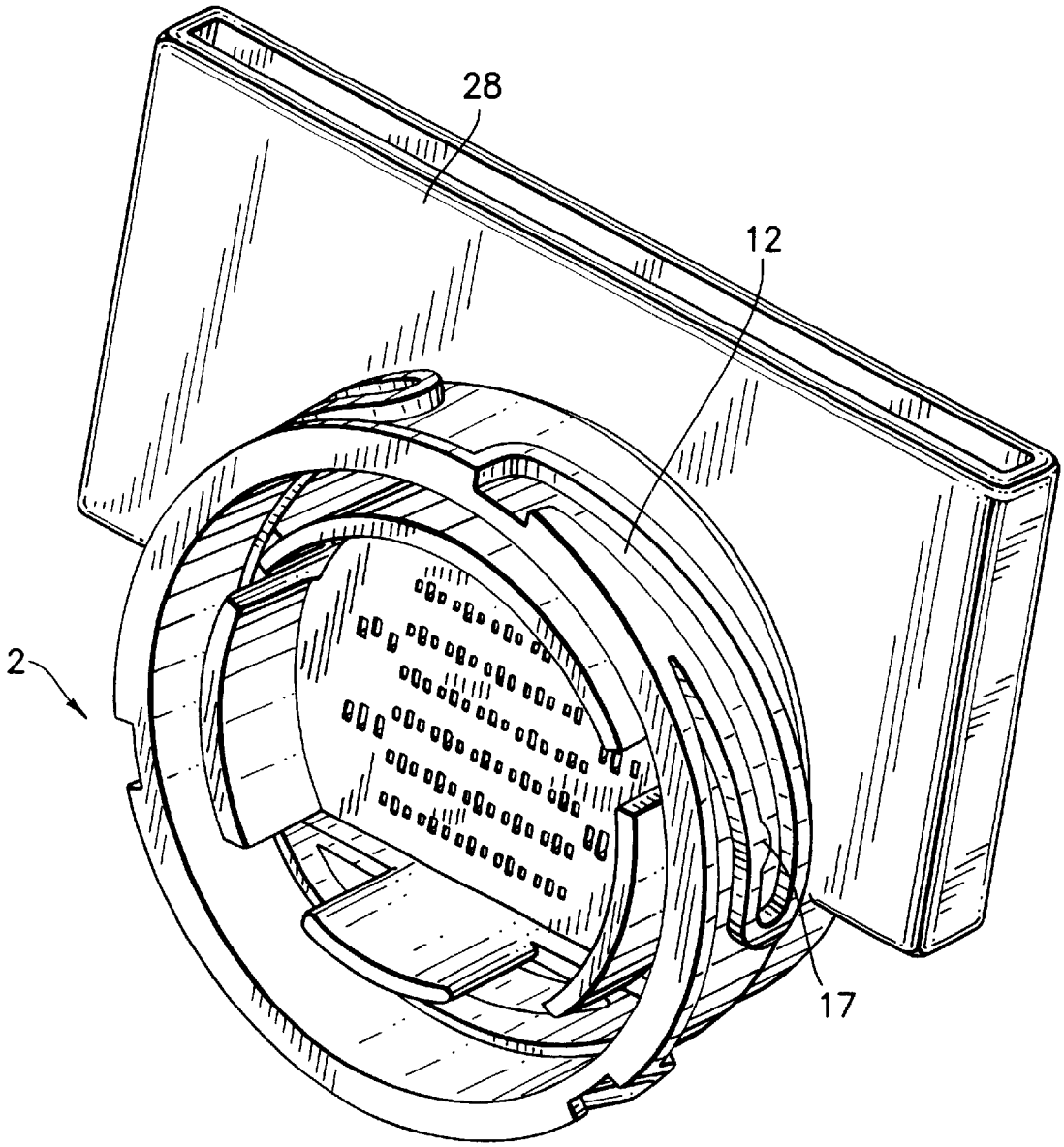
FIG. 3 shows a plug housing of the plug connection.

FIG. 3 shows the substantially cylindrically shaped plug housing 2 with a connecting plate 28 for fixing on a housing wall. Obliquely extending guide grooves 12 are disposed with a 120° offset on the peripheral surface of said plate 28 and receive the studs 11 of the bayonet ring 4 when the latter is closed. At the end of the guide groove 12 a shoulder 17 is formed which, after the stud 11 has overcome said shoulder 17, causes the bayonet ring 4 to be in the closed position. An appropriate force is required to overcome the shoulder 17 so that automatic release of the bayonet ring 4 can be effectively avoided. It should be noted that the spring force is not sufficient to open the bayonet ring in the closed position.

Figure 4:
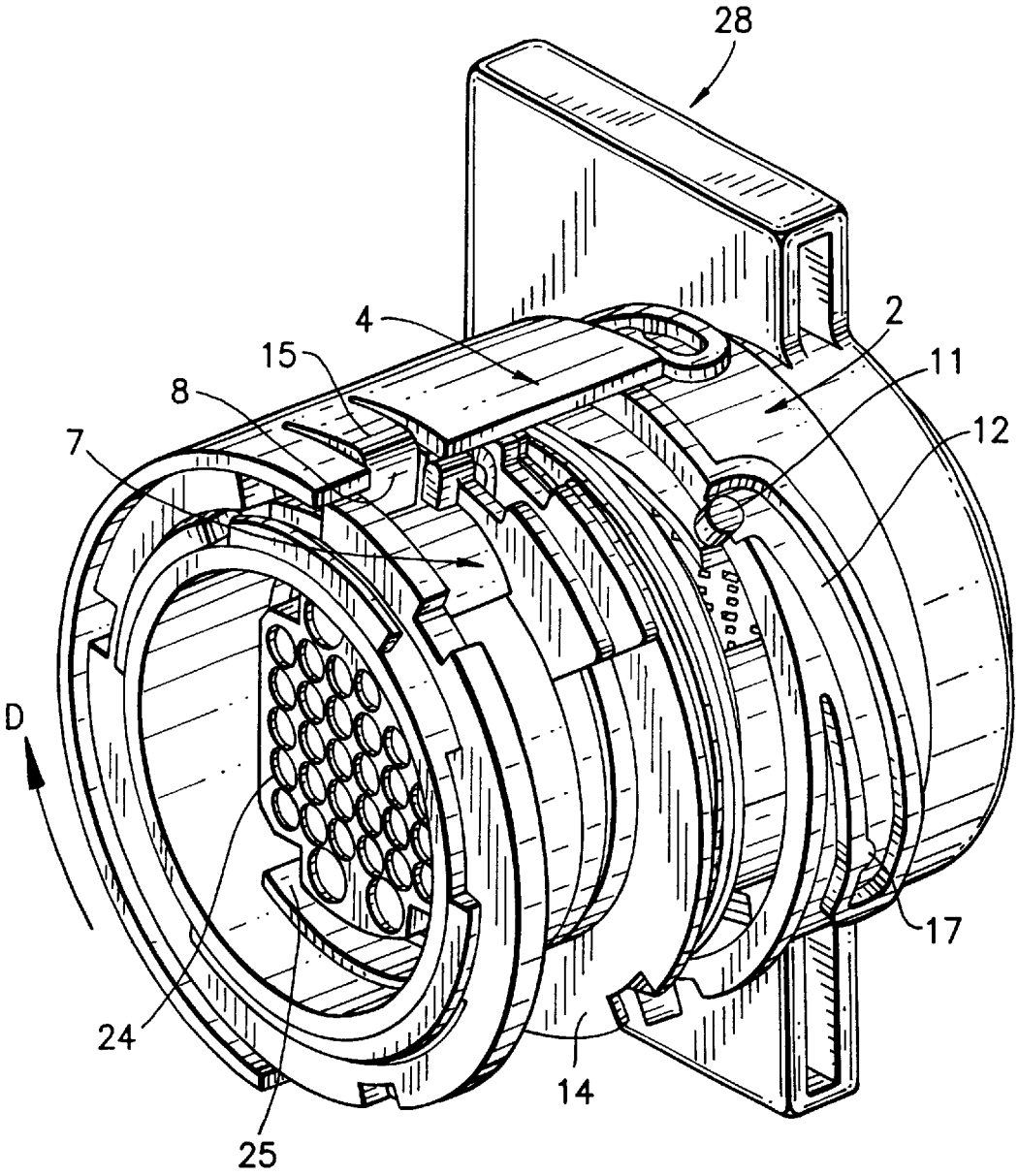
FIG. 4 is a perspective view of the plug connection with a partially sectioned bayonet ring in the open position.
Figure 5:
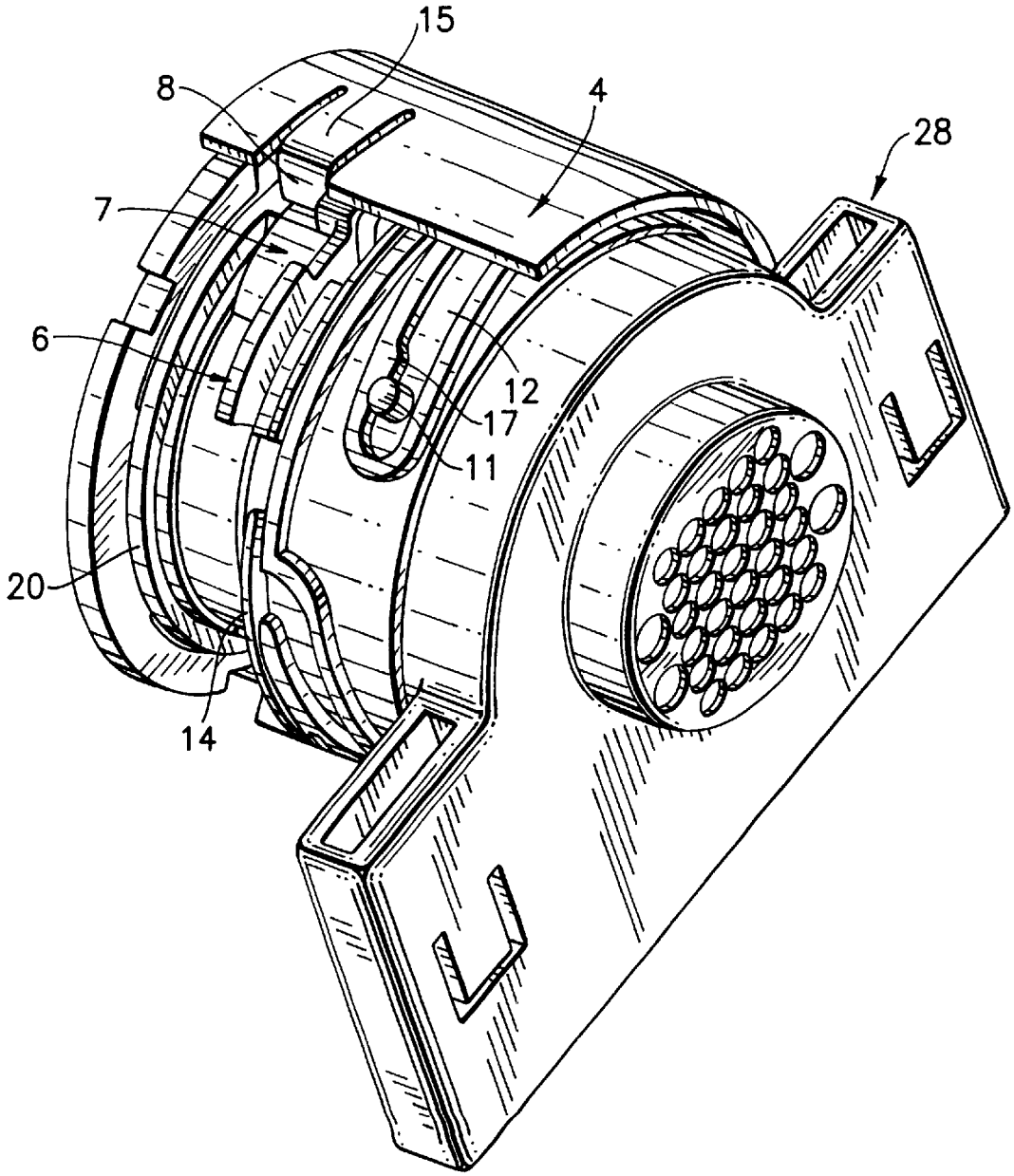
FIG. 5 is a perspective view of the plug connection with a partially sectioned bayonet ring in the closed position.

FIG. 4 is a perspective view of the plug connection in the open position and FIG. 5 shows the plug connection in the closed position. The term "open position" means that the studs 11 are in front of the guide grooves 12, while the bayonet ring 4 belonging to the studs 11 is mounted for rotation about the contact housing 3. In the open position, the end of the rotary slide 6 bears against the edge 27 as will be seen from FIG. 2. The abutment nose 7 also rests on the hook 8 formed on the spring tongue 15. In this condition the spring 16 is substantially unstressed. The term "closed position" means that the studs 11 have overcome the projections 17 during the closing movement and are in the end zone of the guide groove 12.

Figure 6B:
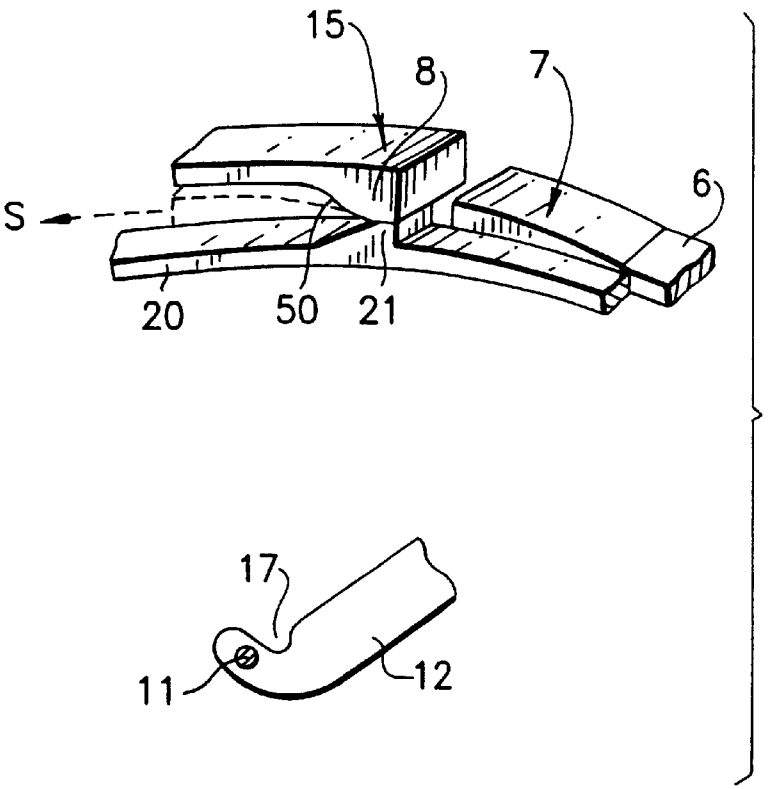
FIG. 6, top half, is an enlarged-scale view of a spring arm of the bayonet ring just before and just after locking while the bottom half shows a stud of the bayonet ring in the guide groove just before and just after the locking of the plug connection.
Figure 6A:
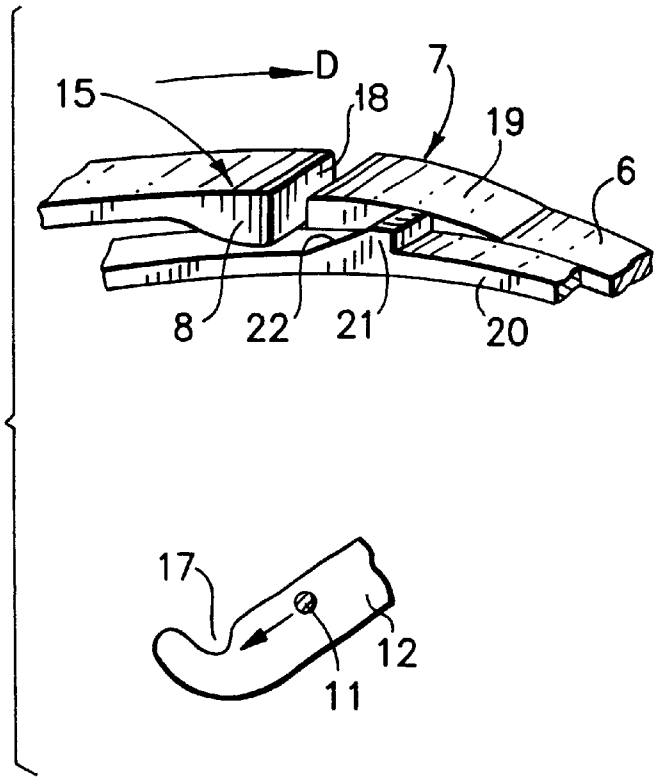

The function of the spring tongue 15 formed at the periphery of the bayonet ring 4 will now be explained with reference to FIG. 6. This drawing shows only the spring tongue 15 with the hook 8 formed thereon, the abutment nose 7 of the rotary slide 6 and the shoulder 20 with the projection 21 formed thereon, of the contact housing 3. The bottom half of FIG. 6 shows only the stud 11 of the bayonet ring 4 and the guide groove 12 with the shoulder 17 of the plug housing 2. FIG. 6*a* shows the electrical plug connection just before the closed position is reached and FIG. 6*b* after the closed position has been reached. The latter position is also shown in FIG. 5. The contact housing 3 and the bayonet ring 4 are introduced into the plug housing 2 (see FIG. 4). As soon as the studs 11 enter the guide groove 12, the bayonet ring 4 with the elastic spring tongue 15 formed thereon is turned by a fitter so as to close it. In these conditions, on the one hand, the stud 11 comes close to the shoulder 17 and, on the other hand, the hook 8 slides on the shoulder 20. In these conditions the spring tongue 15 moves in the direction of arrow D (see also FIG. 4) and the abutment nose 7, which is held against the hook 8 because the spring 16 is now stressed, is entrained.

If the fitter now releases the bayonet ring 4 in an intermediate position of this kind, the stressed spring pulls the abutment nose 7 formed on the rotary slide 6 in the opposite direction to the arrow D, the retaining surface 18 of the abutment nose 7 pressing against the hook 8. The bayonet ring 4 is unscrewed by the spring force and the stud 11 is guided out of the guide groove 12. The bayonet ring is again in its open position as shown in FIG. 4.

If, however, the bayonet ring 4 reaches its closed position, the stud 11 overcomes the shoulder 17 of the guide groove 12. At the same time, the spring tongue 15 turned to the right is lifted from the projection 21 by means of the ramp 22 to an extent such that the abutment nose 7 can pass beneath the hook 8. The spring pulls the rotary slide 6 and abutment nose 7 to the left in the direction of arrow S (broken-line illustration of the abutment nose 7) until the retaining surface 18 meets the edge 27 as shown in FIG. 2. It should be noted that the projection 21 is not absolutely essential, the spring 16 then being continually stressed. The spring 16 stressed in the closed position can facilitate the turning open of the bayonet ring 4. This may even be desirable, depending on the application.

The abutment nose 7 and the hook 8 have ramps 19, 50 so that when the bayonet ring 4 is unturned the spring tongue 15 can better overcome the abutment nose 7. If the abutment nose 7 of the rotary slide 6 abuts the edge 27 of the guide web 13 (see FIG. 12), then on the unturning of the bayonet ring 4 the spring tongue 15 is pushed on to the abutment nose 7. After the spring tongue 15 has overcome the ridge of the abutment nose 7, the spring tongue 15 can entrain the rotary slide 6 on the re-closing of the plug connection, the bayonet ring 4 being turned in the closing direction as shown in FIG. 6*a*. The plug connection is again ready for re-use after complete unturning.

What is claimed is:

1. An electrical plug connection comprising a plug housing, a contact housing complementary to the plug housing and a bayonet ring for locking the plug housing in the contact housing, wherein at least one spring element is arranged to act on at least one movable rotary slide whereby when the bayonet ring is turned into a closed position an increasing stress is exerted on the bayonet ring and further whereby the bayonet ring is incompletely turned toward a closed position, the bayonet rings unturns into an open position, the bayonet ring being thereby locked in its closed position only when it is completely turned to a closed position, the spring element being unstressed when the bayonet ring reaches the closed position.

2. A plug connection according to claim 1, wherein the bayonet ring and one of the two housings comprise a pair of co-operating retaining elements for locking the bayonet ring in a closed position.

3. A plug connection according to claim 1, wherein said rotary slide has an abutment nose associated with which is a hook so that when said bayonet ring is turned in a closing direction the spring element connected to said rotary slide is stressed at one end.

4. A plug connection according to claim 3, wherein at least one projection, when the bayonet ring reaches the closed position, breaks the connection between the abutment nose and the hook so that the spring element is unstressed.

5. A plug connection according to claim 1, wherein said bayonet ring is rotatable with at least one stud around said contact housing and further that said rotary slide is disposed between said bayonet ring and said contact housing.

6. A plug connection according to claim 5, wherein said rotary slide is disposed movably on a guide of said contact housing.

7. A plug connection according to claim 1 wherein said spring element is a tension spring, one end of which is connected to one end of said rotary slide constructed as an annular segment, and the other end of which is connected to said contact housing.

8. A plug connection according to claim 1, wherein a shoulder is formed on the peripheral surface of said contact housing so that a hook disposed internally on said bayonet ring rests on it, and further in that a projection with a ramp for lifting the hook is formed on the shoulder in the radial outward direction of said housing.

* * * * *